US006178959B1

(12) United States Patent
Troncoso, Jr. et al.

(10) Patent No.: US 6,178,959 B1
(45) Date of Patent: Jan. 30, 2001

(54) ADJUSTABLE ARROW REST WITH DEFLECTION INDICATOR

(75) Inventors: Fernando V. Troncoso, Jr.; Vincent Troncoso, both of Montrose, CO (US)

(73) Assignee: Golden Key Futura, Inc., Montrose, CO (US)

( * ) Notice: Under 35 U.S.C. 154(b), the term of this patent shall be extended for 0 days.

(21) Appl. No.: 09/433,776

(22) Filed: Nov. 3, 1999

(51) Int. Cl.[7] ..... F41B 5/22
(52) U.S. Cl. ..... 124/44.5
(58) Field of Search ..... 124/24.1, 44.5

(56) References Cited

U.S. PATENT DOCUMENTS

| | | | | |
|---|---|---|---|---|
| 5,117,803 | * | 6/1992 | Johnson | 124/44.5 |
| 5,421,314 | * | 6/1995 | Kidney | 124/44.5 |
| 5,490,491 | * | 2/1996 | Troncoso | 124/44.5 |
| 5,555,875 | * | 9/1996 | Martin et al. | 124/44.5 |

* cited by examiner

*Primary Examiner*—John A. Ricci

(57) ABSTRACT

An adjustable arrow rest includes an elongated mounting plate provided with a plurality of apertures to facilitate securement of the mounting plate to a bow. The arrow rest also includes a slide block having vertical and horizontal leg portions provided with independently adjustable lead screw mechanisms which allow the precision adjustment of arrow rest launcher arms in vertical and horizontal directions. A substantially vertically extending guide rib disposed adjacent one end of the mounting plate engages a complementary guide channel on the vertical leg portions of the slide block, mounting the slide block for selective reciprocal linear adjustment in a substantially vertical direction relative to the mounting plate. A housing block portion of the arrow rest includes a guide rib disposed in engagement with a complementary guide channel formed on the horizontal leg portion of the slide block, mounting the housing block for selective linear reciprocal movement in a substantially horizontal direction relative to be slide block. A pair of bushings mount a rotary sleeve within a transverse central bore extending through the housing block. A torsional coil spring surrounds the rotary sleeve and provides a restorative spring force. An adjustment dial secured to one end of the torsional coil spring allows selective adjustment of the restorative spring force. A pair of arrow rest launcher arms are secured adjacent one end of a cylindrical shaft secured for rotation within the rotary sleeve by a pair of said screws. The spring adjustment dial includes an outer face provided with a scale that cooperates with an indicator member to provide a visual indication to an archer of the amount of deflection of the arrow rest launcher arms after each shot. The visual indication of deflection allows an archer to make appropriate adjustments to his or her equipment and/or technique.

18 Claims, 4 Drawing Sheets

ADJUSTABLE ARROW REST WITH DEFLECTION INDICATOR

BACKGROUND OF THE INVENTION

The present invention relates to adjustable arrow rests, and more particularly pertains to an improved adjustable arrow rest which provides a visual indication of amount of deflection of arrow rest launcher support arms after each shot. The present invention relates to an adjustable arrow rest of the same general type as the adjustable arrow rest disclosed in U.S. Pat. No. 5,117,803 which issued to Steven C. Johnson on Jun. 2, 1992, the entire disclosure of which is incorporated herein by reference.

SUMMARY OF THE INVENTION

An adjustable arrow rest includes an elongated mounting plate provided with a plurality of threaded apertures to facilitate securement of the mounting plate to a bow. The arrow rest also includes a slide block having vertical and horizontal leg portions provided with independently adjustable lead screw mechanisms which allow the precision adjustment of the position of arrow rest launcher arms in vertical and horizontal directions. A substantially vertically extending guide rib disposed adjacent one end of the mounting plate engages a complementary guide channel on the vertical leg portion of the slide block, mounting the slide block for selective reciprocal linear adjustment in a substantially vertical direction relative to the mounting plate. A housing block portion of the arrow rest includes a guide rib disposed in engagement with a complementary guide channel formed on the horizontal leg portion of the slide block, mounting the housing block for selective linear reciprocal movement in a substantially horizontal direction relative to be slide block. A pair of bushings mount a rotary sleeve within a transverse central bore extending through the housing block. A torsional coil spring surrounds the rotary sleeve and provides a restorative spring force. An adjustment dial secured to one end of the torsional coil spring allows selective adjustment of the restorative spring force. A pair of launcher arms are secured adjacent one end of a cylindrical shaft secured for rotation within the rotary sleeve by a pair of set screws. The spring adjustment dial includes an outer face provided with a scale that cooperates with an indicator member to provide a visual indication to an archer of the amount of deflection of the arrow rest launcher arms after each shot. The visual indication of deflection allows an archer to make appropriate adjustments to his or her equipment and/or technique.

There has thus been outlined, rather broadly, the more important features of the invention in order that the detailed description thereof that follows may be better understood and that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
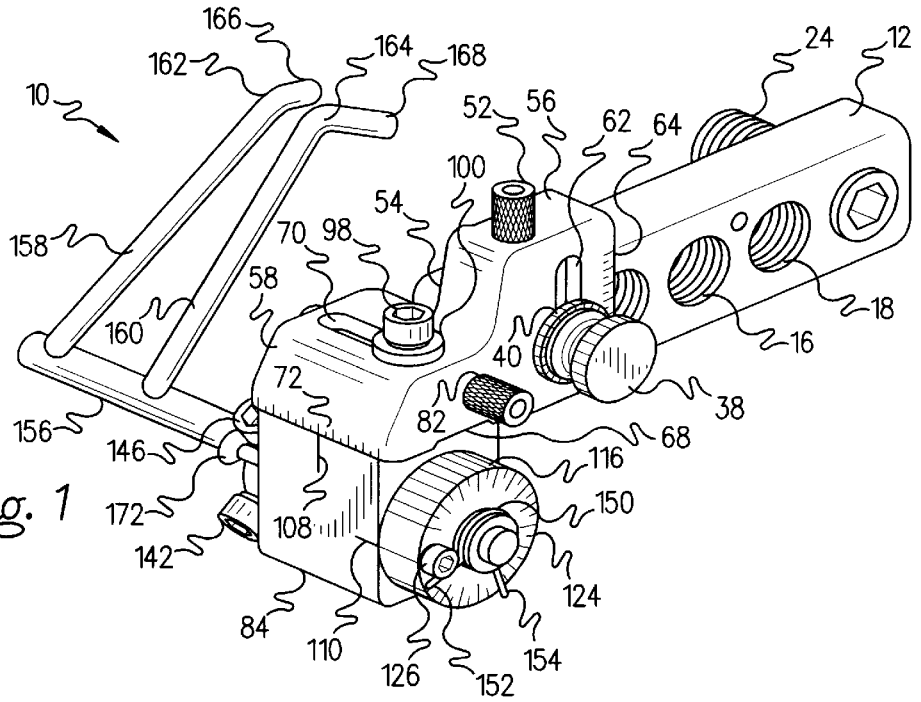
FIG. 1 is a perspective view illustrating an arrow rest according to a preferred embodiment of the present invention.
Figure 2:
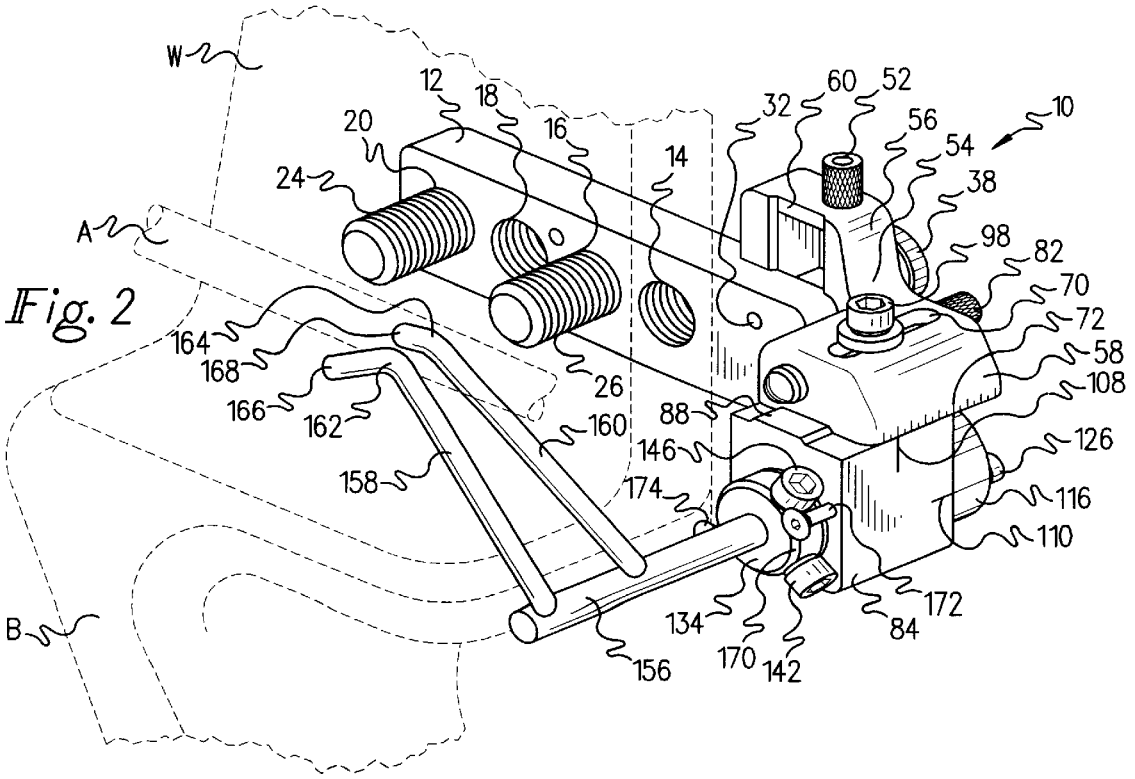
FIG. 2 is a perspective diagrammatic view illustrating an arrow rest according to a preferred embodiment of the present invention mounted upon a bow.

Referring now to the drawings, wherein like reference numerals designate corresponding structure throughout the views, and referring in particular to FIGS. 1 through 8, an improved adjustable arrow rest 10 according to a first preferred embodiment of the invention includes an elongated substantially rectangular mounting plate 12 having four a threaded apertures 14, 16, 18, and 20 disposed in a linear array. The threaded apertures 14, 16, 18, and 20 cooperate with a plurality of threaded fasteners, such as screws 24 and 26, to secure the mounting plate 12 to a bow in a conventional manner. The conventional manner of securement is described in more detail in U.S. Pat. No. 5,117,803, the entire disclosure of which is incorporated herein by reference.

A substantially vertically extending guide rib 28 disposed adjacent a proximal end portion of the mounting plate 12 is divided by a notch 30. A threaded aperture 32 extends transversely through the mounting plate 12 in a central region of the notch 30. A substantially rectangular lead nut 34 includes a smooth bore 36 through which extends a threaded clamp screw 38. The clamp screw 38 extends through a clamping disk or washer 40 preferably formed from rubber or a similar material, through the smooth bore 36 formed through the lead nut 34, and into threaded engagement with the aperture 32 formed in the mounting plate 12. The lead nut 34 includes a reduced thickness foot portion 42 dimensioned and disposed in engagement within the notch 30. A threaded bore 44 extends through the lead nut 34 in a direction transverse to the smooth bore 36 and engages a threaded lead screw 46. A spring washer 48 and a flat washer 50 are disposed between the head of the lead screw 46 and a lower end face of a vertical leg portion 56 of a slide block 54. A knurled adjustment knob 52 is secured adjacent an opposite end of the lead screw 46, at an upper face of the vertical leg portion 56 of the slide block 54. The lead screw 46 extends through a smooth bore 66 formed through the vertical leg portion 56 of the slide block 54. The slide block 54 also includes a horizontal leg portion 58 disposed substantially perpendicular to the vertical leg portion 56.

The vertical leg portion 56 of the slide block 54 includes an elongated guide channel 60 formed complementary to the guide rib 28 of the mounting plate 12. To retain the slide block 54 in a selected vertically adjusted position relative to the mounting plate 12, a user tightens the clamping screw 38 which extends through the slot 62 in the vertical leg portion 56 of the slide block 54, through the smooth bore 36 of the lead nut 34 and into threaded engagement with the aperture 32 in the mounting plate 12, such that the packing disk or washer 40 engages the face of the vertical leg portion 56 of the slide block 54, clamping the slide block 54 against the mounting plate 12. To adjust the vertical position of the arrow rest, a user loosens the clamping screw 38 and manually rotates the knurled vertical adjustment knob 52, causing rotation of the lead screw 46 and resulting in translation of the lead nut 34 axially along the screw 46, in a direction dependent upon the direction of rotation of the knob 52. A scale 64 imprinted or inscribed on the vertical leg portion 56 of the slide block 54 allows a user to visually ascertain a desired adjusted position with a relatively high degree of precision.

The horizontal leg portion 58 of the slide block 54 includes a guide channel 68 underlying a slot 70. A linear scale 72 imprinted or inscribed along an edge of the horizontal leg portion 58 of the slide block 54 assists a user in adjusting the arrow rest to a desired horizontal position. A lead screw 76 extends through a smooth bore 74 formed through the horizontal leg portion 58 of the slide block 54. A spring washer 78 and a flat washer 80 are disposed between a head portion of the lead screw 76 and one face of the horizontal leg portion 58. A knurled knob 82 is secured to an opposite end of the lead nut 76 adjacent an opposite end face of the horizontal leg portion 58.

A substantially rectangular housing block 84 includes a top face 86 provided with a guide rib 88 divided by a notch 90. A threaded aperture 92 is formed transversely in the housing block 84 in a substantially central region of the notch 90. A substantially rectangular lead nut 94 includes a smooth bore 96 adapted for the reception of a clamp screw 98 that terminates in threaded engagement with the aperture 92. The clamp screw 98 forces a packing disk or washer 100 against the outer face of the horizontal leg portion 58 of the slide block 54, clamping the slide block 54 into a selected horizontal adjusted position, with the guide channel 68 disposed in engagement with the complementary guide rib 88. The lead nut 94 includes a reduced thickness foot portion 102 disposed in engagement with the notch 90. A threaded bore 104 extends through the lead nut 94 in a direction transverse to the smooth bore 96.

A rear face 106 of the housing block 84 includes a pair of index marks 108 and 110. The index mark 108 cooperates with the linear scale 72 on the horizontal leg portion of the slide block 54 to indicate a selected adjusted horizontal position of the housing block 84 relative to the slide block 54. The index mark 110 is used to indicate a selected restorative spring force, in a manner to be described subsequently.

A central cylindrical smooth bore 112 extends through the housing block 84 in a direction parallel with the longitudinal extent of the horizontal guide rib 88. A torsional coil spring 114 includes a first end portion 115 disposed in engagement with an aperture (not shown) formed in an inner end face of a cylindrical adjustment dial 116. An opposite radially inwardly directed end 117 of the torsional coil spring 114 is disposed in engagement with a radially directed aperture (not shown) formed in a cylindrical rotational sleeve 130. The dial 116 includes a reduced diameter bushing portion 118 disposed for rotation within the bore 112. A central cylindrical bore 120 formed through the dial 116 receives and forms a journal bearing for an end portion of the rotary sleeve 130. A clamp screw 126 extending through a smooth bore 122 formed through the dial 116 and into threaded engagement with a threaded aperture 128 formed in an end face of the housing block 84 allows a user to clamp the dial 116 in a selected adjusted position to regulate the restorative spring force of the torsional coil spring 114 by winding or unwinding the spring. A scale 124 inscribed or imprinted on the outer face and cylindrical sidewall of the dial 116 cooperates with the index mark 110 to allow a user to adjust spring tension with an absolute high degree of precision. As disclosed in U.S. Pat. No. 5,117,803, the disclosure of which is hereby incorporated by reference herein, a plurality of threaded apertures 128 may be provided in the housing block 84, disposed in a circular array adjacent the periphery of the central bore 112 to permit adjustment of the spring force in discrete, repeatable increments.

The elongated cylindrical rotary sleeve 130 includes a central cylindrical bore 132 and an enlarged cylindrical head portion 134. A washer or bushing 136 abuts an inner face of the enlarged head 134 and is secured in position by a snap ring (not shown) disposed within a circumferential groove 138. The bushing 136 serves as a journal bearing mounting the sleeve 130 for rotation within the bore 112 of the housing block 84.

A pair of threaded apertures 140 and 144 extend in a radial direction through the cylindrical sidewall of the enlarged head 134 of the rotary sleeve 130 for the purpose of receiving respective set screws 142 and 146.

A circumferential snap ring groove 148 disposed adjacent an end of the rotary sleeve 130 axially remote from the enlarged head 134 receives a partial snap ring portion 150 of an indicator member. The indicator member includes angularly diverging legs 152 and 154 which cooperate with the scale 124 formed on the outer circular face of the dial 116 to indicate maximum deflection of arrow rest launcher arms, in a manner to be described subsequently in greater detail.

A cylindrical support shaft 156 mounts a pair of angularly converging launcher arms 158 and 160. The launcher arms 158 and 160 include respective radiused bend portions 162 and 164, and terminate in angularly diverging end portions 166 and 168.

Figure 6:
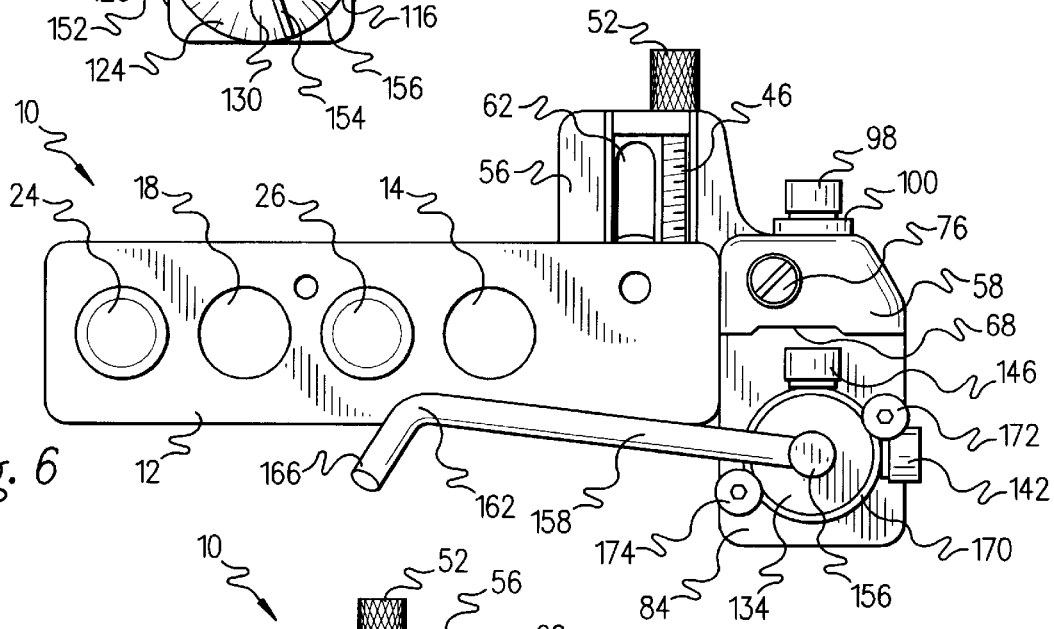
FIG. 6 is a left side elevational view illustrating an arrow rest according to a preferred embodiment of the present invention, with the arrow rest launcher arms disposed in a maximum downward deflected position.

As shown in FIG. 6, the enlarged head portion 134 of the rotary sleeve 130 includes a radially outer chamfered edge portion 178. A pair of taper head screws 172 and 174 engage respective threaded apertures formed in the housing block 84 and serve to constrain the rotary sleeve 130 against movement out of the central bore 112 of the housing block 84. The screw 172 serves the additional function of acting as a stop by virtue of engagement with the set screws 142 and 146 to define maximum elevated and depressed positions of the launcher arms 158 and 160.

Figure 3:
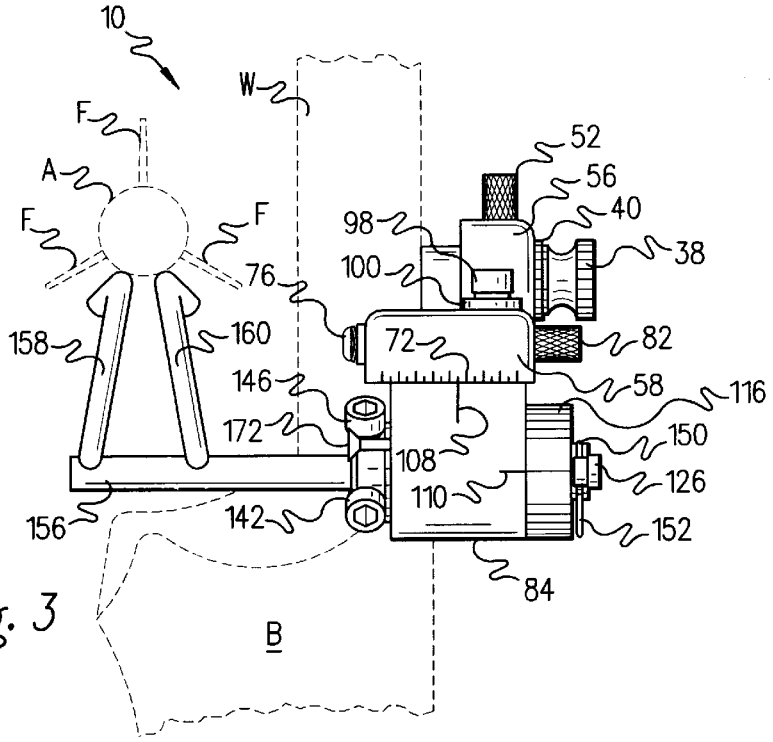
FIG. 3 is a rear elevational view illustrating an arrow rest according to a preferred embodiment of the present invention mounted upon a bow.
Figure 4:
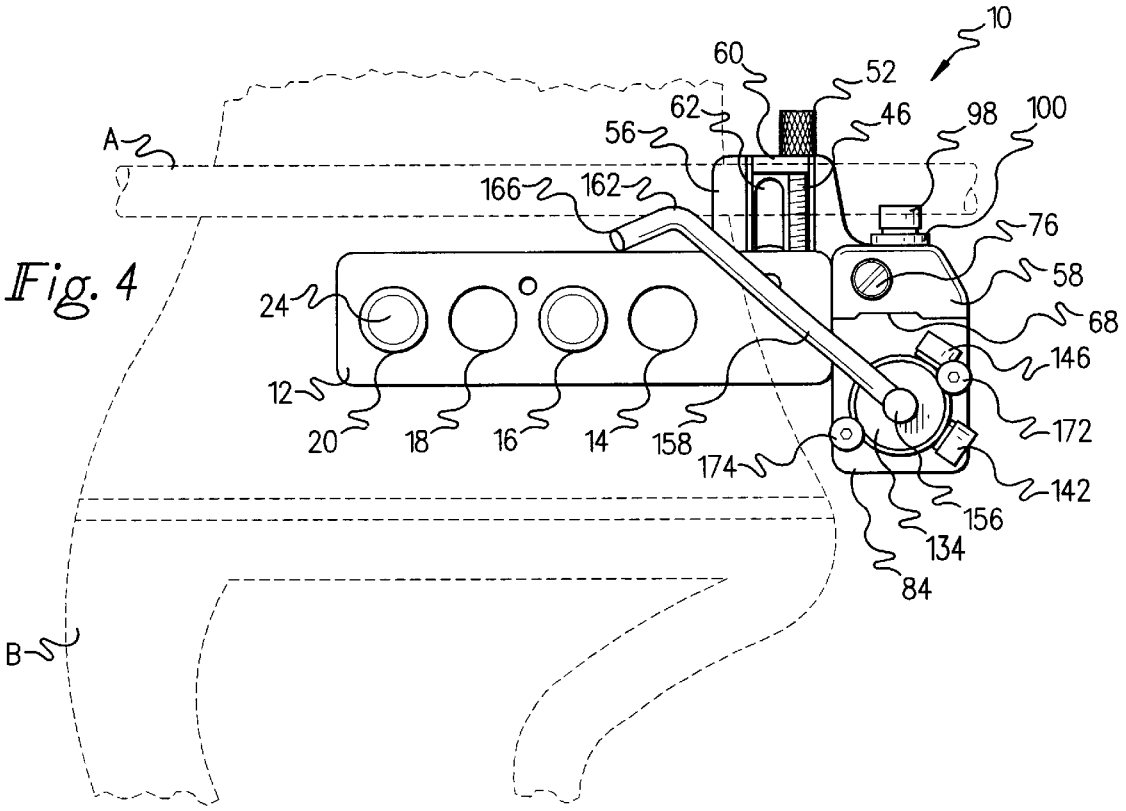
FIG. 4 is a left side elevational view illustrating an arrow rest according to a preferred embodiment of the present invention mounted upon a bow.
Figure 5:
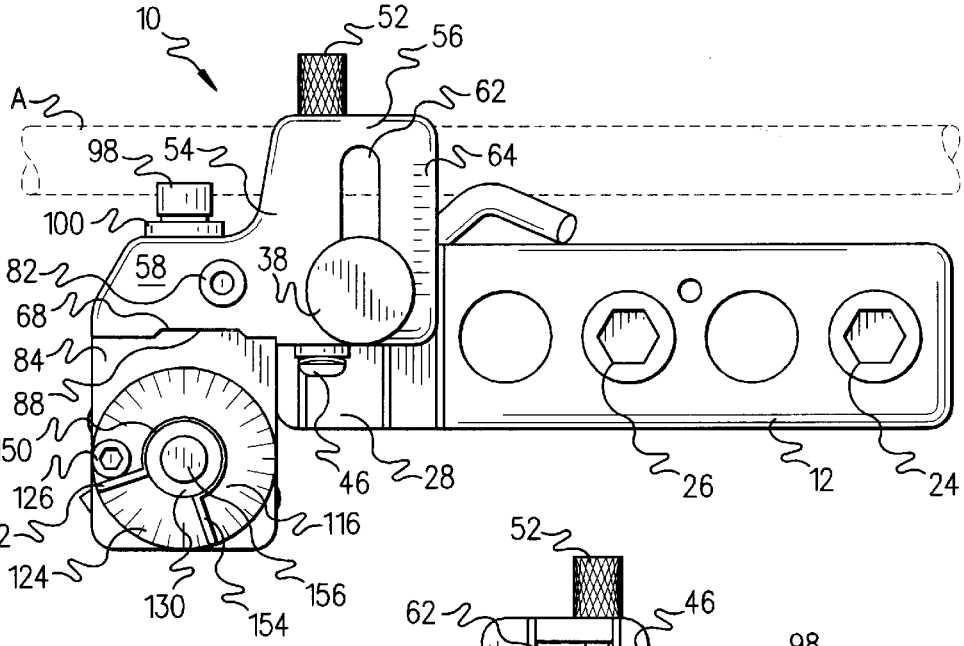
FIG. 5 is a right side elevational view illustrating an arrow rest according to a preferred embodiment of the present invention, with a deflection indicator member disposed in a reset position prior to a shot.

The manner of use of the arrow rest 10 according to the preferred embodiment of the present invention will now be described. With reference to FIG. 3, an archer places an arrow A on the launcher arms 158 and 160 in the illustrated position within the window W of the bow B, with the feathers or fletching F oriented as shown. In this initial position, the launcher arms 158 and 160 will be disposed in a maximum elevated position, with the set screw 146 disposed in abutment with the stop screw 172, as shown in FIG. 4. The legs 152 and 154 of the deflection indicator will be disposed in the position illustrated in FIG. 5, with the indicator leg 152 disposed in abutment with the screw 126. In the event that the leg 152 is not disposed in abutment with the head of the screw 126 as shown in FIG. 5, a user manually moves the indicator legs 152 and 154 into the illustrated position. This is readily accomplished by virtue of the sliding engagement of the indicator snap ring portion 150 within the snap ring groove 148 (FIG. 8) of the rotary sleeve 130.

Figure 7:
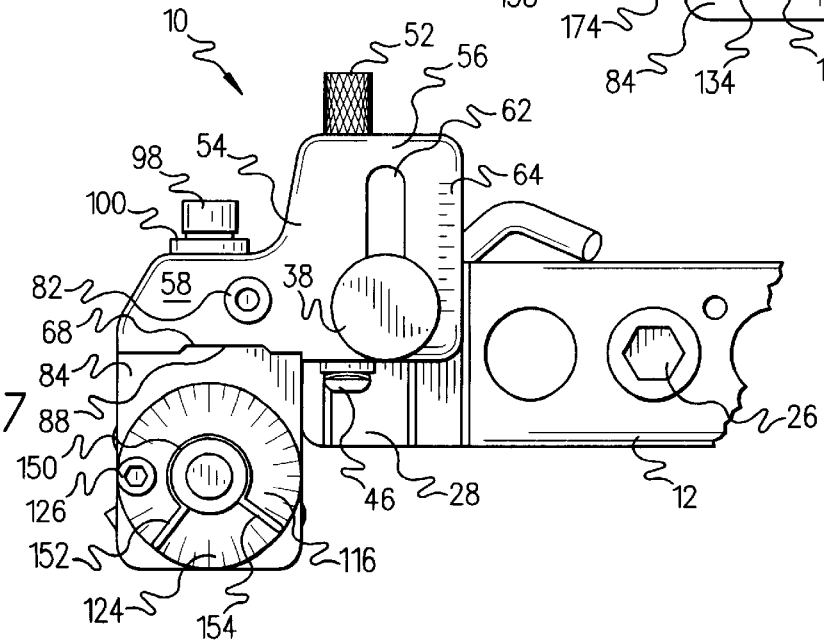
FIG. 7 is a partial right side elevational view illustrating an arrow rest according to a preferred embodiment of the present invention, with a deflection indicator member disposed in a deflection indication position subsequent to a shot.
Figure 8:
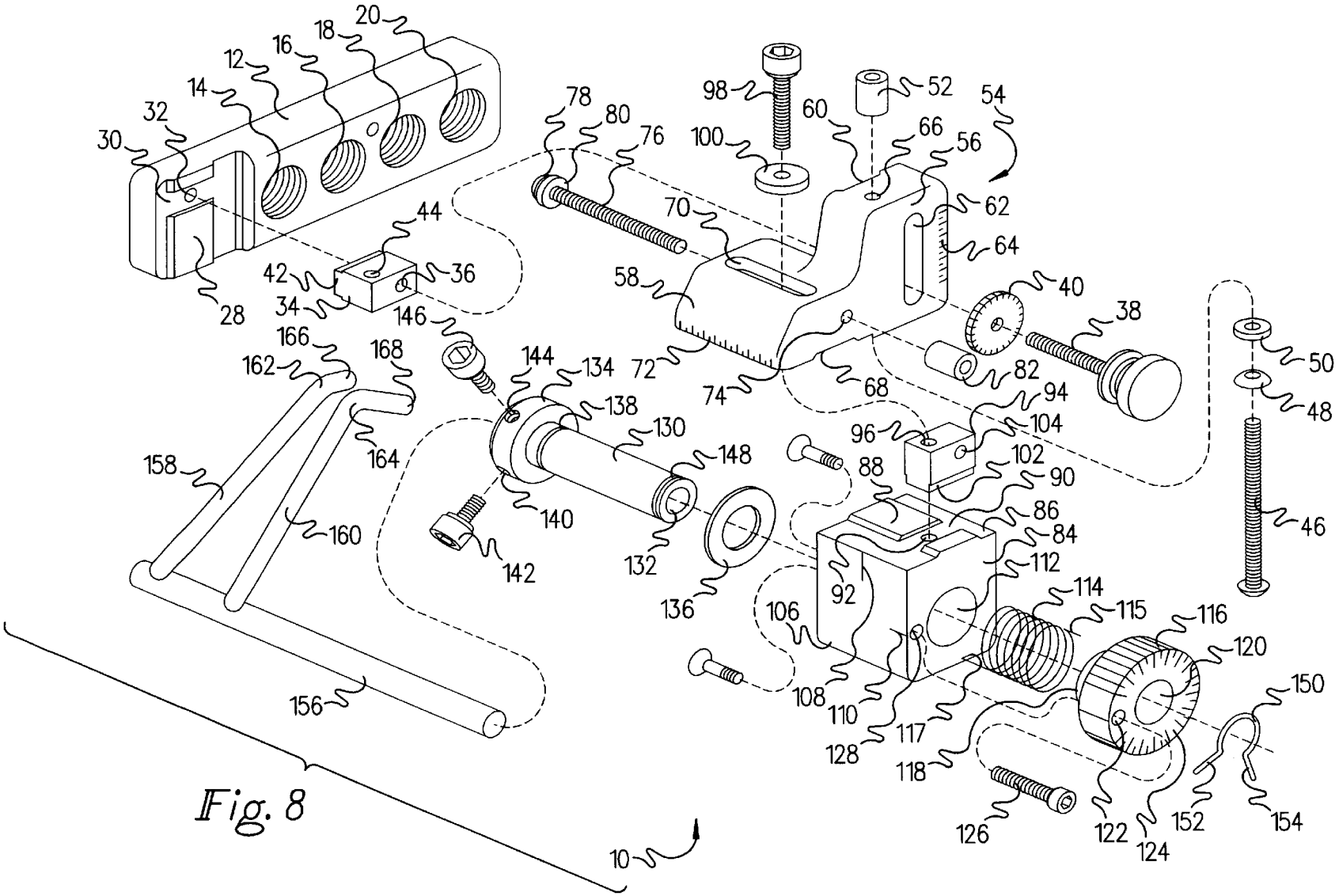
FIG. 8 is an exploded perspective view illustrating an arrow rest according to a preferred embodiment of the present invention.

With reference to FIG. 4, during the course of an archery shot, the launcher arms 158 and 160 will be deflected downwardly. This deflection will cause the support shaft 156 and rotary sleeve 130 to rotate in a counter-clockwise direction, as viewed in FIG. 4. The maximum downward deflection of the launcher arms 158 and 160 is limited by abutment of the set screw 142 with the stop screw 172, as shown in FIG. 6. Because of the restorative bias of the spring 114, the launcher arms 158 and 160 will spring back to the maximum elevated position shown in FIG. 4 after each shot. Due to the relatively high speed at which the deflection and subsequent return to an elevated position occurs, the maximum deflection of the launcher arms 158 and 160 would be extremely difficult to accurately discern in the absence of an indication mechanism. With reference to FIGS. 5 and 7, as the shaft 156 and rotary sleeve 130 rotate in a clockwise direction and reach the point of maximum downward deflection of the launcher arms 158 and 160, abutment of the leg 152 with the head of the screw 126 prevents the indicator legs 152 and 154 from rotating with the rotary sleeve 130, causing the snap ring portion 150 to slide within the snap ring groove 148 of the rotary sleeve 130 to an extent corresponding with the maximum downward deflection of the launcher arms 158 and 160. When the launcher arms 158 and 160 return to the maximum elevated position illustrated in FIG. 4 after the shot, the maximum downward deflection of the launcher arms will be indicated by the position of the indicator leg 152 on the scale 124, as shown in FIG. 7.

While the preferred embodiment of the invention has been illustrated and described with respect to rectangular guide ribs and complementary channels to permit adjustment in horizontal and vertical directions, other guide configurations and adjustment mechanisms may be employed within the scope of the present invention. For example, dovetail guide members may be employed to permit horizontal and vertical adjustment.

Further, while the invention has been described and illustrated with respect to a mechanical indicator for indicating and retaining an indication of an amount of deflection of at least one arrow rest launcher arm after a shot, it should be noted that this feature may be implemented using electronic digital measuring devices within the scope of the invention. In this alternative construction, deflection of the launcher arm might, for example, be stored in memory and displayed on an LED or other electronic visual display. Additionally, an electronic embodiment of the present invention might include provisions for storing deflection of an arrow rest launcher arm on a plurality of shots, and for conducting statistical computations based upon deflection for a group of shots. Toward this end, the electronic embodiment of the present invention may include provisions for interface with a personal computer to enable an archer to transfer information, maintain a log, make statistical calculations, print graphs, etc.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. In an archery arrow rest including at least one launcher arm for supporting an arrow, said launcher arm mounted to permit some deflection, the improvement comprising:

means for indicating an amount of deflection of said at least one launcher arm.

2. The improvement of claim 1, wherein said means for indicating an amount of deflection includes a scale.

3. The improvement of claim 1, further comprising means for indicating a maximum amount of deflection of said at least one launcher arm.

4. The improvement of claim 1, further comprising means for retaining an indication of an amount of deflection of said at least one launcher arm after a shot.

5. The improvement of claim 1, further comprising means for retaining an indication of a maximum amount of deflection of said at least one launcher arm after a shot.

6. In an archery arrow rest including at least one launcher arm for supporting an arrow, said launcher arm mounted to permit some deflection, the improvement comprising:

an indicator operably connected to said at least one launcher arm and operative to provide a visual indication of a degree of deflection of said launcher arm.

7. The improvement of claim 6, wherein said indicator is operative to provide an indication of a maximum amount of deflection of said launcher arm.

8. The improvement of claim 6, further comprising a scale cooperating with said indicator to provide said visual indication.

9. The improvement of claim 6, wherein said indicator retains an indication of an amount of deflection of said launcher arm after a shot.

10. In an archery arrow rest including at least one launcher arm mounted to deflect a limited extent when an arrow is shot, the improvement comprising:

a scale; and at least one indicator connected to said launcher arm and cooperating with said scale to provide a visual indication of an amount of deflection of said launcher arm.

11. The improvement of claim 10, further comprising means for adjusting a horizontal position of said launcher arm.

12. The improvement of claim 10, further comprising means for adjusting a vertical position of said launcher arm.

13. The improvement of claim 10, further comprising means providing a restorative force to return said launcher arm to an undeflected position after a shot.

14. The improvement of claim 13, wherein said means providing a restorative force comprises at least one spring.

15. The improvement of claim 13, further comprising means for adjusting said restorative force.

16. A method of shooting an arrow with an archery bow including an arrow rest with at least one deflectable launcher arm, the improvement comprising the step of:

mechanically recording an amount of deflection of said launcher arm that occurs when an arrow is shot from said bow.

17. The method of claim 16, further comprising the step of providing a visual indication of an amount of deflection of said launcher arm that occurs when an arrow is shot.

18. The method of claim 16, further comprising the step of providing a visual indication of a maximum amount of deflection of said launcher arm that occurs when an arrow is shot.

* * * * *